US005233124A

United States Patent [19]

Peterson

[11] Patent Number: 5,233,124

[45] Date of Patent: Aug. 3, 1993

[54] FIREARM TOOL

[76] Inventor: Thomas K. M. Peterson, 124 Stoney Point Rd., Courtland, Minn. 56021

[21] Appl. No.: 917,821

[22] Filed: Jul. 21, 1992

[51] Int. Cl.[5] ..... G01B 3/46; F42B 35/02

[52] U.S. Cl. ..... 86/1.1; 33/506; 42/90; 42/95; 86/24; 86/43

[58] Field of Search ..... 42/90, 95; 86/23, 24, 86/1.1, 43; 33/506; 102/430

[56] References Cited

U.S. PATENT DOCUMENTS

| | | | |
|---|---|---|---|
| 1,251,247 | 12/1917 | Lanfranco | 33/125 |
| 3,209,461 | 10/1965 | Wilson | 33/506 |
| 4,608,762 | 9/1986 | Varner | 33/506 |
| 4,866,871 | 9/1989 | Rivers | 42/95 |
| 4,901,465 | 2/1990 | Hsu | 42/95 |

*Primary Examiner*—Harold J. Tudor
*Attorney, Agent, or Firm*—Lawrence M. Nawrocki

[57] ABSTRACT

A tool for use in conjunction with a firearm to facilitate the performance of various functions with regard to the firearm. The tool includes a cartridge case simulator which is mounted at a distal end of a tubular rod. The end of the simulator opposite an end at which a bullet is to be positioned for subsequent identification of a desired location relative to an intended corresponding cartridge case is provided with an aperture, and an axial passage in the simulator, thereby, communicates with an axial duct in the tubular rod, the rod and simulator being axially aligned. A gauge shaft is disposed for reciprocal movement along the axial aligned passage and duct. A distal end of the shaft is intended to engage the base of a bullet so that the bullet can be urged to a desired axial position relative to a mouth of the cartridge case simulator. The invention provides means for locking the shaft against relative axial movement with respect to the tubular rod when the desired axial location of the bullet is achieved.

8 Claims, 5 Drawing Sheets

86
84
80
92
28
46
62
24
30
26
82
32
100
98
80
28
92
96
46
88
90
86
84
94

FIREARM TOOL

TECHNICAL FIELD

The present invention deals broadly with the field of firearms. More narrowly, however, it is directed to a multi-purpose tool for use particularly with breech-loading, bolt-action or single shot rifles and handguns, although it can be used with other types of firearms. Specific applications of the tool are facilitating ammunition loading or reloading for a specific firearm, evaluating the degree of wear and/or erosion to the firearm throat and/or lands of the rifling which might result from repeated firing of the firearm, and protecting the chamber, throat, receiver, and lands and grooves of the rifling during cleaning of the firearm.

BACKGROUND OF THE INVENTION

There are numerous aspects of firearm usage and implementation. Certainly, there is a military application. Firearm applications, however, are broader than that. They are used in hunting, target shooting, etc.

To many people, firearm usage, maintenance, and care go far beyond a hobby. To many individuals, firearms are an avocation. To such people, safe use, precision, and accuracy of a weapon are paramount considerations. Consequently, bulk manufactured shell cartridges are unacceptable for use.

Each firearm has its own unique characteristics, and those characteristics vary over time because of wear. Even if there were no wear, however, as indicated above, every gun has its own individual characteristics. For example, throat, which is expanded radially with respect to the bore, does not have a length which is in accordance with an industry standard. That is, the throat length of each weapon will vary from that of other guns.

It will also be understood that clearance, as defined hereinafter, will vary even for the same weapon depending upon the characteristics of a bullet which is being used. The particular purpose for which the bullet is intended will cause the length and shape of the bullet to vary. Further, bullet lengths and shapes vary according to manufacturing and performance considerations. Consequently, the importance of precision in loading and reloading of a cartridge becomes even further highlighted.

In a typical weapon, the barrel has a rifled bore defined by a plurality of spiraling, alternating grooves and lands. At the rear end of the bore, there is a radially expanded throat in which the major longitudinal portion of a bullet, mounted at the front end of a cartridge case, is disposed when the case is received within the chamber. Since the diameter of the bullet closely approximates the diameter of the bore, there will be an annular space surrounding the bullet within the throat when the case is received within the chamber. The relative positioning of the bullet axially within the throat (measured in terms of "clearance"), the radial dimension of the annular space, and other factors will bear upon the safe operation, the accuracy of the weapon, etc. Over time and usage of the weapon, surfaces of the bore, including the grooves and lands spiraling therewithin, the throat, and the chamber (including the mouth to the chamber) will erode. Consequently, the characteristics of the particular firearm will change as time passes.

Typically, the chamber will determine the axial location of the cartridge case. The relative positioning of the bullet within the case will, therefore, vary the characteristics of the firearm. While, theoretically, all particular weapons having a particular caliber might be intended to have substantially identical characteristics, every firearm is unique. Consequently, the desire to load and reload bullets to cartridge cases results.

Clearance, as previously discussed, is the axial distance between the forwardmost location of the widest portion of the bullet and the rearmost limit of the bore, when the cartridge case is fully received within the chamber. For target rifles, zero clearance is sometimes best for maximum accuracy. That is, target rifles are, sometimes, most accurate when the bullet is mounted to the cartridge case at a relative position thereto so that, when the case is fully received within the chamber, the forwardmost location of the widest part of the bullet is closed up against the entrance to the bore.

On the other hand, such a relationship is not optimum for hunting rifles. With hunting rifles, some clearance must exist for reliable and safe operation. Zero clearance might be optimum for maximization of precision if other factors are not involved. As indicated above, however, for hunting rifles, some bullet clearance must be present.

Zero clearance has a number of drawbacks. For example, there is a risk that the case might be extracted and the bullet left wedged in the entrance to the bore. If that occurred, powder would spill out into the chamber, the mouth thereof, and the throat. The weapon would, effectively, be put out of commission. Again, the need for precise manual loading and reloading of cartridge cases becomes highlighted.

In current practice, an individual will effect loading or reloading by determining the maximum overall cartridge length, typically, arbitrarily. The bullet will then be seated within the mouth of the cartridge case and friction or press fit therewithin to accomplish this desired length.

As will be able to be seen, the way manual loading is accomplished in current practice is basically arbitrary. Consequently, uniformity and reliability are lost.

Further, new firearms should, shortly after purchase, be evaluated for freebore (that is, throat length) and allowance made by the manufacturer. It is important that such an evaluation be performed prior to using the firearm in order to assess how accurate the weapon will be in use. Such an assessment will be made with respect to any of a number of chosen projectiles.

Additionally, typically when cleaning firearms, the chamber, receiver, lands and grooves within the bore, and surrounding surfaces can become damaged by the cleaning rod and cleaning rod tips and brushes. Damage to these surfaces may result in loss of accuracy.

Further, the chamber, receiver, and surrounding surfaces can become contaminated by chemical agents. In the cleaning process, solvents and other chemicals are used, and deleterious effects can be brought to bear upon these surfaces.

It is to these problems and dictates of the prior art that the present invention is directed. It is a firearm tool which can be employed in manual loading to provide for a desired and uniform cartridge length. Further, it can serve to protect the various surfaces inside the weapon barrel during the cleaning function.

SUMMARY OF THE INVENTION

The present invention is a tool device for use with firearms. It is specifically intended for use with a conventional firearm including a barrel which has, defined therein, beginning at an end of the barrel remote from the stock, a bore, a widened throat, adjacent the bore and generally coaxial therewith, and a widened chamber which has a diameter greater than the throat portion. The chamber is coaxial with the throat and it configured to have seated therein, when the weapon is ready for firing, a cartridge case to which a bullet has been loaded. The present device includes a cartridge case simulator. The simulator is provided with an open rear end and a narrowed mouth portion at a forward end. The simulator defines an axial passage therethrough, and is in virtually all respects, with the exception of the open rear end, substantially identical to a cartridge case which mounts a bullet for use during firing operations. Means are provided to position the simulator at a location fully seated within the chamber. The invention includes means for urging a bullet when the simulator is so seated, along the axial passage passing through the simulator. The bullet is, thereby, positioned at a desired axial location with respect to the mouth of the simulator. Finally, the device includes means for locking, relative to the simulator, the means by which the bullet is urged along the axial passage. The bullet is thereby concurrently held at the desired axial position within the mouth of the simulator.

In a preferred embodiment of the invention, the means by which the simulator is positioned within the chamber includes a tubular rod which mounts, at its distal end, the simulator. The tubular rod has an axial duct formed therethrough, and, when the simulator is mounted at the distal end of the rod, the passage through the simulator and the duct through the rod are axially aligned.

The means by which the bullet is urged to its intended axial position relative to the mouth of the cartridge case can take the form of a gauge shaft which is disposed for reciprocation along the aligned axial passage in the simulator and axial duct in the tubular rod. Typically, the tubular rod would be maneuvered to urge the cartridge case simulator to a position fully seated within the chamber. Thereafter, the shaft would be manipulated like a plunger to urge a bullet received within the simulator outwardly to a desired position relative to the mouth of the cartridge case simulator. This position could be one wherein there would be zero clearance between the bullet and the entrance to the bore, although this would not necessarily always be the case. If the bullet were maneuvered to a "zero clearance" position, the shaft could be locked against further relative axial movement with respect to the tubular rod by, for example, a lock screw passing through an aperture in the tubular rod or a collar carried thereby. The lock screw would be tightened down against the gauge shaft to preclude additional axial movement. Thereafter, the shaft could be backed out of the tubular rod a desired distance to effect an intended clearance of the bullet relative to the entrance to the bore.

The present invention is thus an improved tool for use with firearms. More specific features and advantages obtained in view of those features will become apparent with reference to the DETAILED DESCRIPTION OF THE INVENTION, appended claims, and accompanying drawing figures.

DETAILED DESCRIPTION OF THE INVENTION

Figure 1:
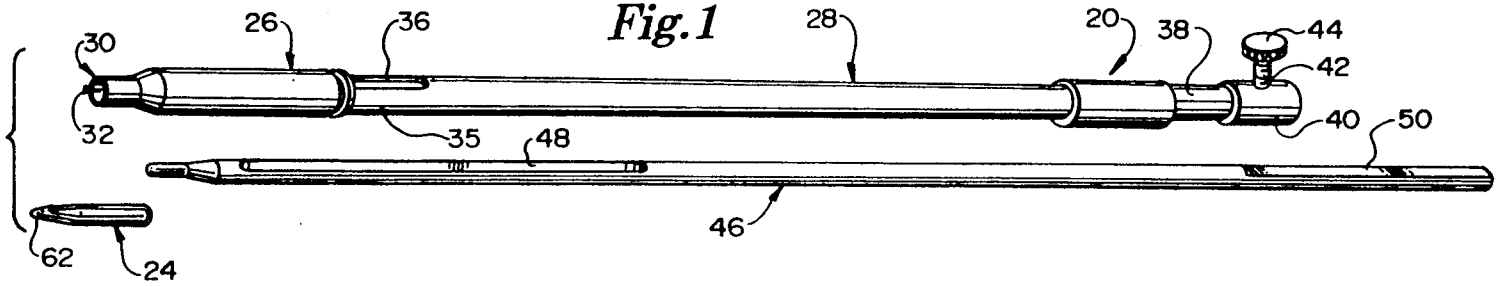
FIG. 1 is an exploded perspective view of an embodiment of the present invention.
Figure 2:
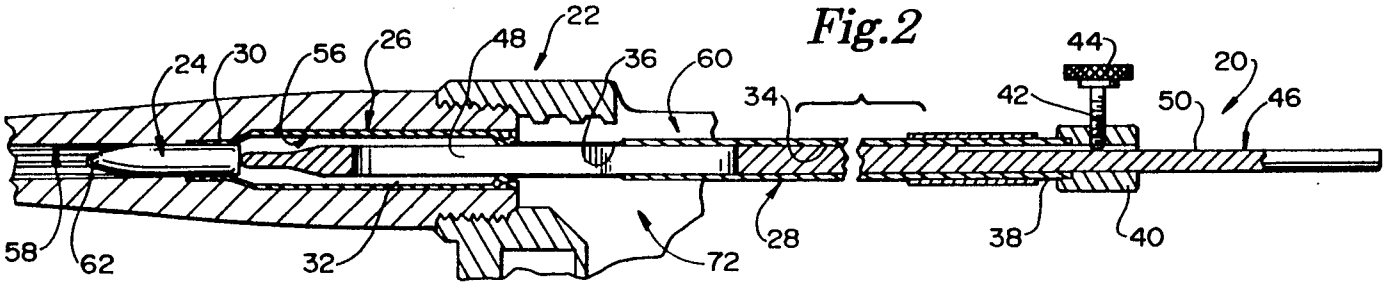
FIG. 2 is a fragmentary view, orthographic to the longitudinal axis thereof, showing the invention in assembly with a bolt action rifle and having some parts thereof broken away.
Figure 3:
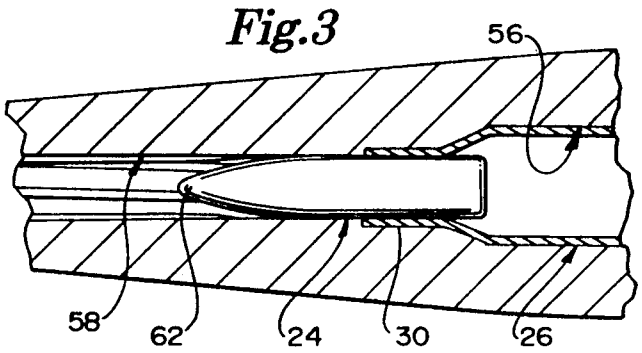
FIG. 3 is an enlarged fragmentary detail thereof showing a bullet positioned loosely within the freebore.
Figure 4:
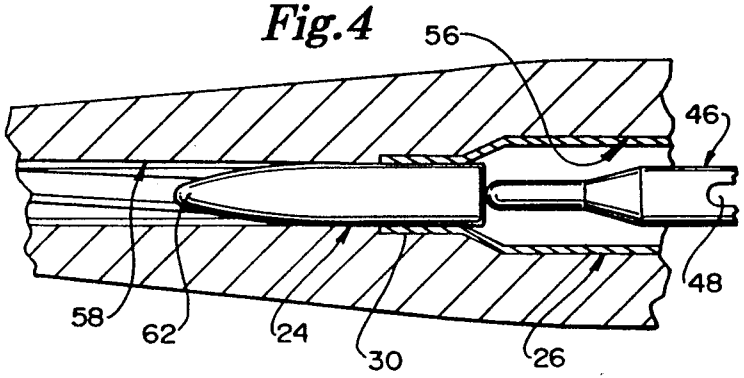
FIG. 4 is a view similar to that of FIG. 3 showing the bullet urged to fill the freebore.

Referring now to the drawings wherein like reference numerals denote like elements throughout the several views, FIGS. 1–2 show the structure of a first embodiment of the present invention, and FIGS. 2–5 show the operation of that embodiment. The tool 20 in accordance with the present invention is intended to be used for a number of purposes. Two purposes are to evaluate the characteristics of a firearm 22 after purchase and prior to use, and to facilitate loading of a bullet 24 in a corresponding cartridge case (not shown) usable with the firearm 22. FIG. 1 illustrates a cartridge case simulator 26 which is mounted to the forward end of a tubular rod 28. The cartridge case simulator 26 is substantially identical to a cartridge casing intended to be used in the firearm 22. It has a narrowed mouth portion 30 at a forward end, the mouth portion 20 intended to receive a bullet 24 therewithin.

While in the case of an actual cartridge, the bullet 24 would be tightly fitted within the mouth portion of the cartridge case by means of press fitting or crimping, it is intended that, in the case of the simulator 26, the bullet 24 would slide through the mouth portion 30 with a close tolerance. The purpose for this relative sizing will become apparent with reference to discussion hereinafter.

The simulator 26 differs from a cartridge casing in one main respect. The rear end of the simulator 26 is open, and the cartridge case simulator wall, thereby, defines an axial passage 32 therethrough.

As best seen in FIG. 2, the simulator 26 is coaxially mounted with the tubular rod 28. Mounting can be permanent (for example, by brazing), or removable (for example, by internally threading the open rear end of the simulator 26 and externally threading the distal end 35 of the tubular rod 28 so that the simulator 26 can be readily attached or detached from the rod 28). If the construction is the latter embodiment, one will be able to see that different sized simulators can be employed with the same tubular rod so as to afford a universal character to the tool 20.

The tubular rod 28 has a duct 34 extending axially therethrough. When the cartridge case simulator 26 is mounted to the distal end 35 of the tubular rod 28, the axial passage 32 through the simulator 26 and the axial duct 34 through the tubular rod 28 are aligned.

The distal end 35 of the tubular rod 28 immediately proximate the simulator 26 is shown as having a slot 36 formed therein, the slot 36 extending fully to the rear end of the simulator 26. An opposite end 38 of the tubular rod 28 is shown as having a collar 40 attached thereto, attachment being accomplished in any appropriate manner. The collar 40 is provided with an aperture 42 which has an axis extending generally transversely to the axis of elongation to the rod 28. A knurled-headed lock screw 44 is shown as being threaded into the aperture 42 in the collar 40, and it will be understood that the lock screw 44 can be selectively reciprocated in a threaded action fashion into and out of the aperture 42. Advantages achieved by the provision of the slot 36 and the lock screw 44 will be discussed hereinafter.

FIGS. 1 and 2 also illustrate a gauge rod 46 which is intended to be received within the aligned axial passage 32 in the simulator 26 and the axial duct 34 in the tubular rod 28. The gauge rod 46 is disposed for reciprocation along the aligned passage 32 and duct 34.

As best seen in FIG. 1, the gauge rod 46 can be provided with a slot 48 proximate its forward, or plunger, end. The slot 48 is positioned at a location and is of a length so that, as the gauge rod 46 is reciprocated along a normal operational throw, the slot 48 in the gauge rod 46 will be coextensive along the length of the slot 36 in the tubular rod 28.

Figure 5:
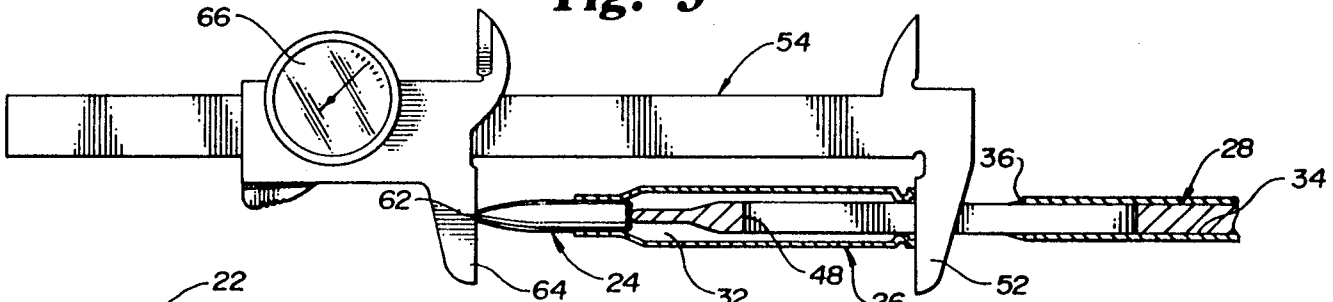
FIG. 5 is a side elevational view of the invention in combination with a caliper, some portions being broken away.

FIG. 1 also illustrates the end of the gauge rod 46 remote from the simulator 26 as being provided with a flat surface 50. The relative positioning of the lock screw 44, the slot 36 in the tubular rod 28, the slot 48 in the gauge rod 46, and the flat surface 50 is such that, when the lock screw 44 is screwed down to engage the gauge rod 46 and is tightened against the flat surface 50, the slots 36, 48 in the tubular rod 28 and gauge rod 46 will be aligned. As a result, one arm 52 of a caliper 54 will be able to be inserted into the aligned slots 36, 48 in a manner as seen in FIG. 5.

In operation, the cartridge case simulator 26 is mounted to the tubular rod 28 if the embodiment is one in which the simulator 26 is detachable. If the simulator 26 is permanently attached to the tubular rod 28, of course, the attachment step is moot.

The gauge rod 46 is then inserted into the axial duct 34 in the tubular rod 28 and urged to a position wherein it has entered into the axial passage 32 in the cartridge case simulator 26. This step is performed without having to insert the bullet 24 into the aligned duct 34 and passage 32, since the mouth 30 of the cartridge case simulator 26 is sufficiently expanded so that the bullet 24 can be inserted into the mouth end of the simulator 26 with the gauge rod 46 already in place. It will be understood of course that the mouth 30 of the simulator 26 is not expanded to a point at which the bullet 24 would be free to wobble excessively. The fit should be sufficiently snug so that there is no wobble, yet sufficiently loose so that the bullet 24 can be freely passed through the mouth 30 of the simulator 26.

The bullet 24 would be forced to a position at which it were retracted sufficiently within the simulator 26 so that, when the simulator 26 is seated within the chamber 56 of a firearm 22, there will be excessive clearance (that is, the axial distance between the forwardmost portion on the bullet 24 at which the greatest diameter of the bullet 24 is achieved, and the entrance to the bore 58). The tool 20 is inserted into the barrel of the firearm 22 (typically through the receiver 60) until the cartridge case simulator 26 is solidly seated within the chamber 56. The gauge rod 46 is then urged forwardly to engage the base of the bullet 24 (if engagement has not already occurred) and to urge the bullet 24 forwardly within the simulator 26 until there is a zero clearance situation achieved. The lock screw 44 can then be firmly tightened against the flat surface 50 of the gauge rod 46 to maintain the gauge rod 46 in a fixed relative position with respect to the tubular rod 28/cartridge case simulator 26 assembly.

The tool 20 is then withdrawn from the barrel of the firearm 22. During withdrawal, the bullet 24 might slide out of the simulator 26. This presents no problem since the gauge rod 46 remains fixed relative to the tubular rod 28/cartridge case simulator 26 assembly. As a consequence, the bullet 24 can merely be again inserted into the mouth 30 of the simulator 26 and be permitted to engage the forwardmost end of the gauge rod 46.

With the tool 20 so configured, a typical veneer micrometer caliper 54 can be employed to measure the distance from the rearend of the simulator 26 to the pointed forward end 62 of the bullet 24. This can be done by inserting one of the caliper arms or jaws through the aligned slots 36, 48 of the tubular rod 28 and gauge rod 46 and adjusting the other arm 64 or jaw down against the pointed forward end 62 of the bullet 24. If the caliper 54 has a dial-type guage 66, an accurate reading can be taken as to this length, and this length can be utilized in loading or reloading cartridges which employ a case the same as the simulator 26 and a bullet 24 the same as that used in performing the measurement.

It will be understood that any number of bullets could be appropriately loaded or reloaded to cartridge cases in this manner. Because of wear, however, it is appropriate and prudent to reperform length calculations at intervals. For certain applications, it is desired to load or reload bullets so that the cartridge is configured with something greater than zero clearance. The caliper measurement taken can then be adjusted appropriately by subtracting a desired distance from the overall length measured at "zero clearance" conditions.

It will also be understood that similar steps can be performed in evaluating for freebore shortly after the purchase of the firearm 22. Again, frequent remeasurement is prudent because of wear that will be occasioned upon the inner surfaces of the firearm 22.

Figure 7:
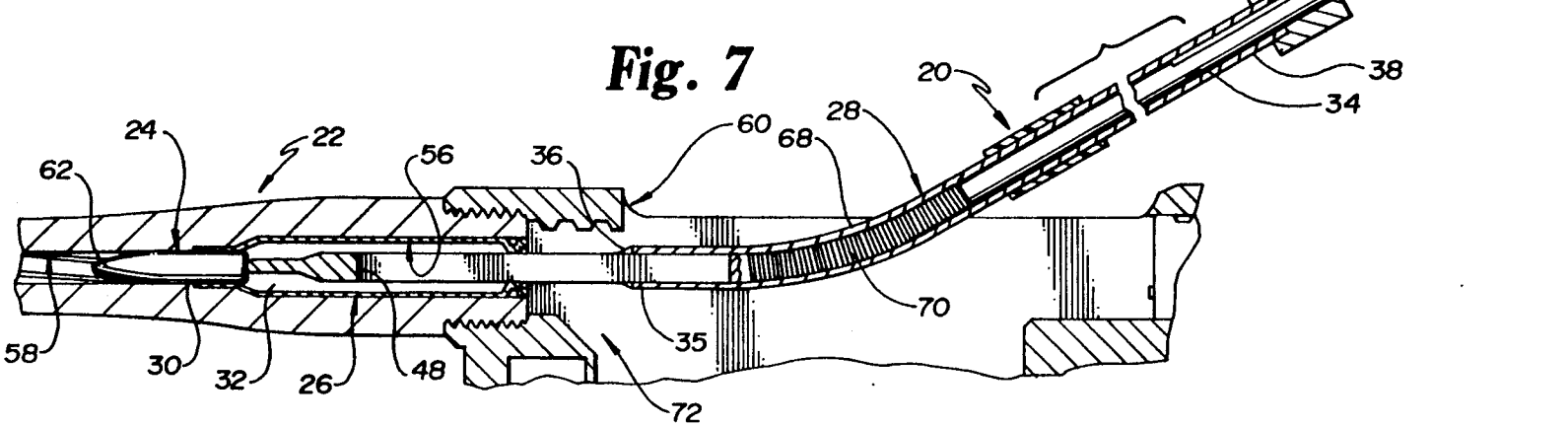
FIG. 7 is a view similar to that of FIG. 2 showing a second embodiment of the invention.

Other embodiments of the tool 20, as applied to these purposes, are envisioned. For example, FIG. 7 illustrates a tubular rod 28 which has an arcuate section 68. The gauge rod 46 is provided with a shaft which has a flexible section 70 proximate the location of the arcuate section 68 of the tubular rod 28 so that the gauge rod 28 can still be reciprocated through the aligned axial passage 32 in the simulator 26 and axial duct 34 in the tubular rod 28. The embodiment illustrated in FIG. 7 is one which is appropriate for desired entry through the lock 72 of the weapon 22.

Figure 10:
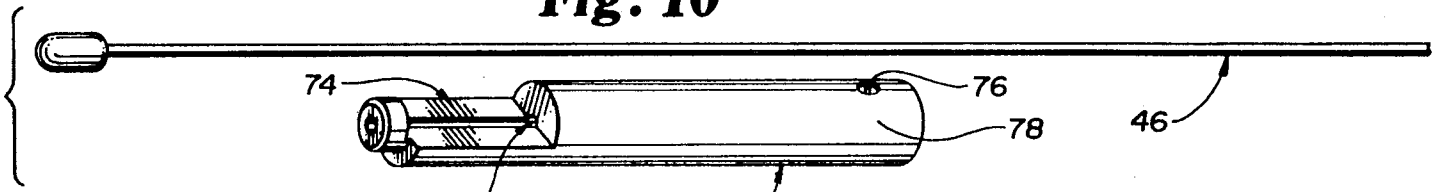
FIG. 10 is an exploded view of another embodiment of the invention.
Figure 11:
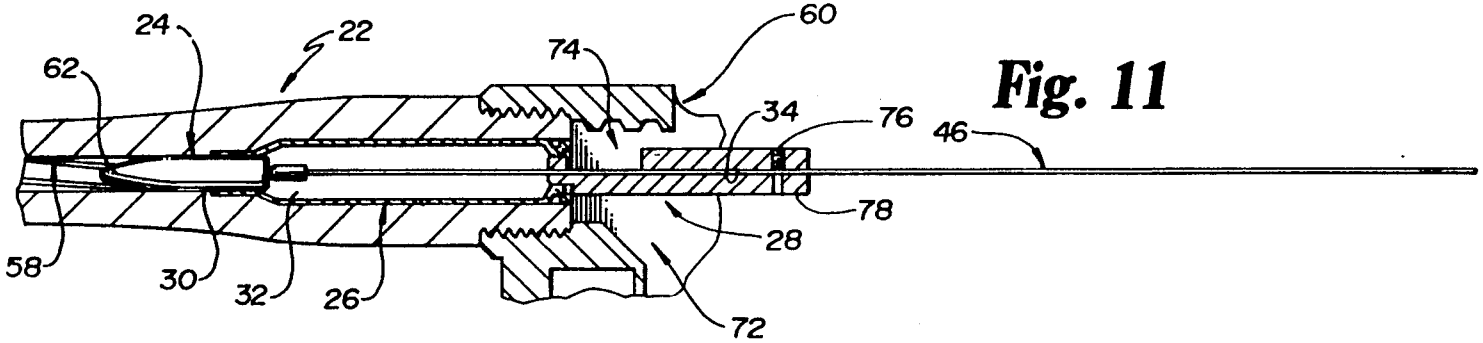
FIG. 11 is a view similar to that of FIG. 2 showing the embodiment of FIG. 10 in assembly with a rifle.
Figure 12:
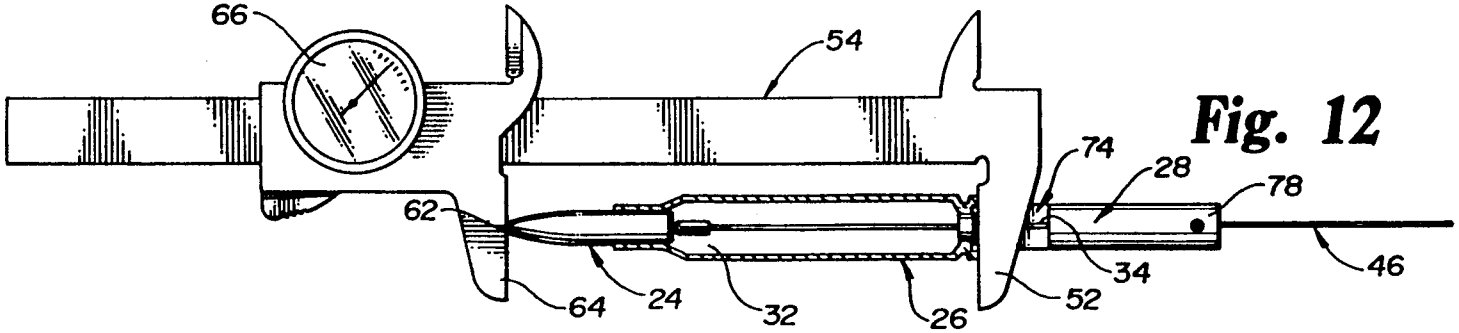
FIG. 12 is a view thereof similar to FIG. 5.

FIGS. 10, 11, and 12 illustrate another embodiment which is smaller and more compact. In that embodiment, a semi-cylindrical section is removed from the tubular rod 28 proximate the rear end of the simulator 26, as at 74. In this embodiment, the removal of this section serves the same function as does the provision of the slot 36 in the embodiment previously discussed.

In this embodiment, a set screw or lock screw 76 is also provided to impinge upon the gauge rod 46. The embodiment illustrated in FIGS. 10–12 is not shown as employing a collar 78 for mounting the set screw 76.

This embodiment does not employ a gauge rod 46 having a flat surface. Rather, the diameter of the gauge rod 46 is relatively small, and the gauge rod 46 is fully impinged upon by the set screw 76 to hold the gauge rod 46 in a desired axial position with respect to the tubular rod 28.

Figures 13, 14, 15:
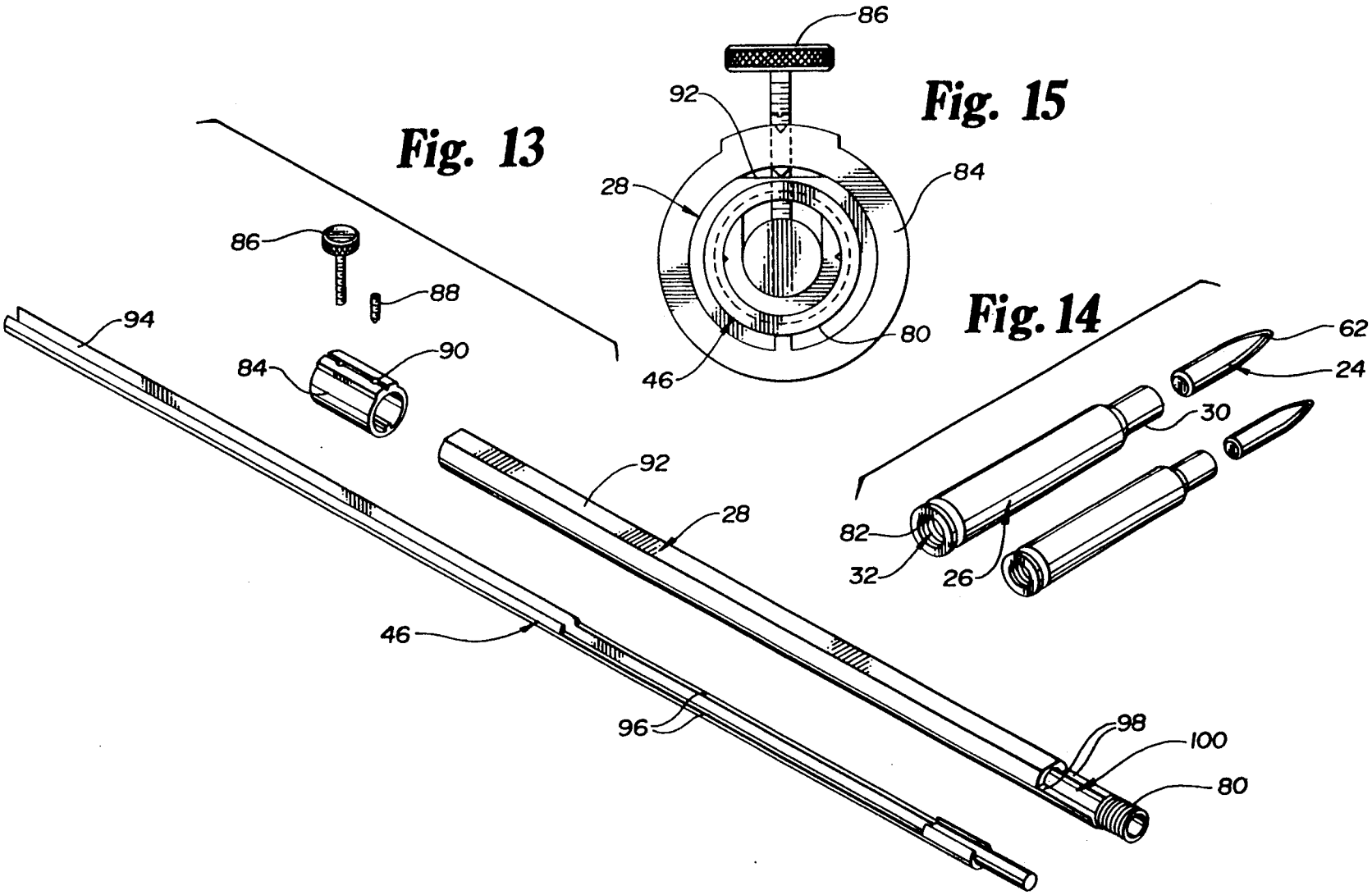
FIG. 13 is a perspective view of still another embodiment shown exploded.
FIG. 14 is a perspective view thereof showing a modified cartridge simulator.
FIG. 15 is a distal end view thereof showing assembly of elements of FIG. 13.

FIGS. 13–15 illustrate still another embodiment of the invention. This embodiment is specifically illustrated as being provided with an externally threaded extension 80 at the forward end of the tubular rod 28 for threading into an internally threaded aperture 82 in the base of the cartridge case simulator 26. Again, this embodiment is specifically intended for adaptation to utilize simulators of different sizes.

The embodiment illustrated in FIGS. 13–15 is shown as employing a collar 84 for receiving the lock screw 86. The collar 84 can be mounted to the tubular rod 28 by means of a set screw 88 threadedly inserted through a set screw hole 90 and brought into engagement with a flat surface 92 on the tubular rod 28.

The gauge rod 46 is shown as having a groove 94 formed in its upper surface (that is, the surface immediately underlying the flat surface 92 of the tubular rod 28). The groove or linear relief 94 is formed in this surface to accommodate the lock screw 86, when the lock screw 86 is not threaded down into tight engagement with the gauge rod 46, as the gauge rod 46 is made to reciprocate. Consequently, the gauge rod 46 can be maintained in the appropriate circumferential orientation with respect to the tubular rod 28/simulator 26 assembly. As a result, flats 96 proximate the forward end of the gauge rod 46 will cooperate with flats 98 defined by the removal of a semi-cylindrical portion (as at 100) proximate the forward end of the tubular rod 28 to allow for insertion of the caliper arm 52.

Figure 6:
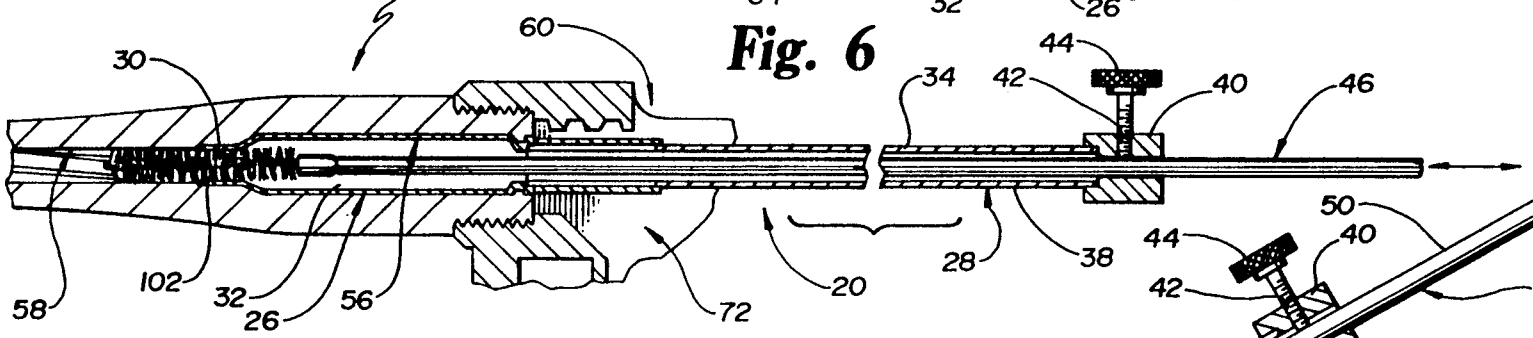
FIG. 6 is a view similar to that of FIG. 2 showing some parts removed and replaced by a cleaning rod.
Figure 8:
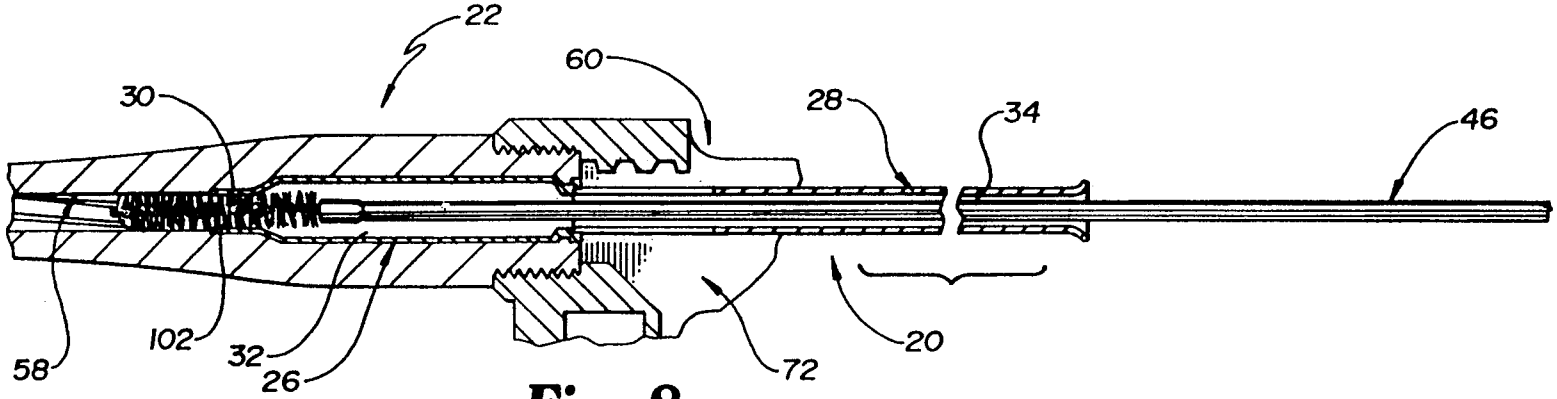
FIG. 8 is a view similar to that of FIG. 2 showing another embodiment of the invention in combination with a cleaning rod.
Figure 9:
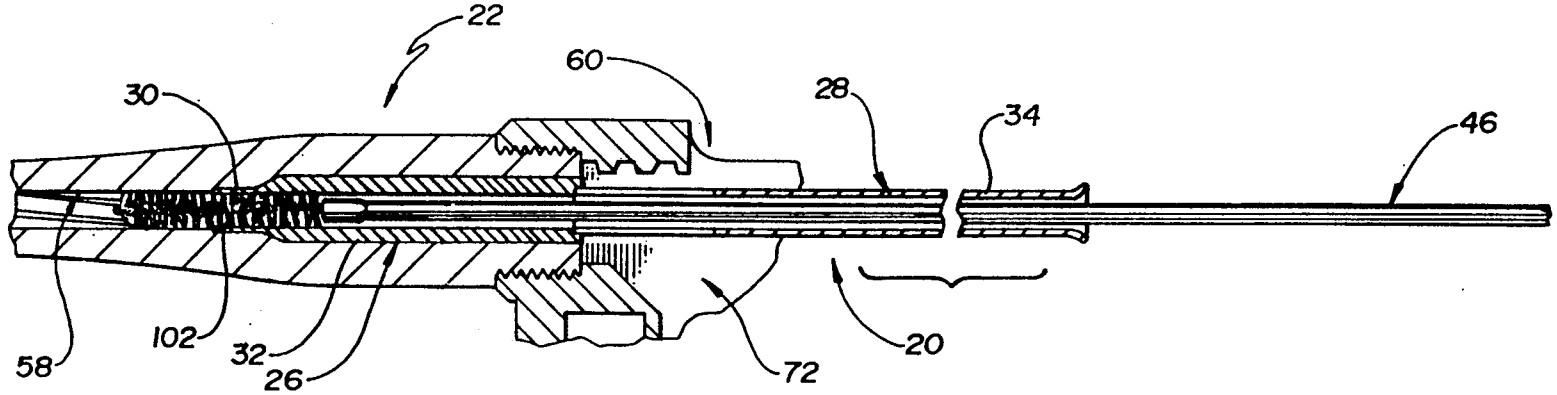
FIG. 9 is a view similar to that of FIG. 8 illustrating an alternative mounting of a cartridge case simulator.

As previously discussed in this document, the tool 20 has at least one other application in addition to the freebore evaluation function and loading/reloading calculation function. That application is one wherein the assembly forms a shield to protect the internal weapon surfaces against erosion, chipping, etc. during the performance of, for example, a cleaning evolution. The assembly can also form a shield to protect against caustic effects from cleaning agents. FIGS. 6, 8, and 9 illustrate the tool 20 serving such a function. The plunger head of the other applications has been replaced with a cleaning head 102. A cleaning head 102 can comprise a brush, a swab, or other appropriately configured cleaning member. As can be clearly seen in those figures, the chamber 56 and all inner components of the firearm 22 rearward of the chamber 56 are positively protected against the deleterious effects that might be occasioned by such an implement.

It will be understood that, in this application, the lock screw 44, 86 would be either removed or withdrawn to a point at which it would not impinge upon the cleaning plunger. Consequently, the plunger would be free to urge the cleaning swab or brush along its throw in cleaning the bore of the weapon 22.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. Apparatus for facilitating loading of a bullet in a corresponding cartridge case, having a forward mouth in which the bullet is to be tightly fitted, for use in a specific firearm with which the cartridge is compatible, wherein the firearm includes a barrel having defined therein, from a distal end thereof, a bore, a widened throat, adjacent the bore and generally coaxial therewith, a greater widened chamber, adjacent the throat and generally coaxial therewith, and a receiver adjacent the chamber, the chamber configured to seat therein, for firing, a cartridge case in which a bullet has been loaded, comprising:

(a) a cartridge case simulator, said simulator having an open rear end and a narrowed mouth portion at a forward end, said simulator defining an axial passage therethrough;

(b) means for positioning said simulator in a location seated within the chamber, said means for positioning said simulator including a tubular rod having an axial duct extending therethrough, said tubular rod having means, disposed at a distal end thereof, for mounting said simulator at a fixed axial and rotational relationship relative thereto, wherein said axial passage in said simulator and said axial duct in said tubular rod are aligned;

(c) gauge means for urging a bullet, when said simulator is seated within the chamber, along said axial passage, said gauge means including a shaft received for slidable reciprocal movement through said aligned axial passage through said simulator and said axial duct through said tubular rod; and (d) means for locking said gauge means relative to said simulator to hold the bullet at a desired axial position within said mouth portion of said simulator wherein a portion of said bullet extends axially beyond the mouth portion of said simulator at said forward end of said simulator.

2. Apparatus in accordance with claim 1 wherein said locking means comprises means, carried by said tubular rod, for impinging upon said shaft to lock said shaft against axial movement through said axial duct formed in said tubular rod.

3. Apparatus in accordance with claim wherein said impinging means comprises a collar carried at an end of said tubular rod opposite an end at which said simulator is mounted and a lock screw threadedly disposed in an aperture oriented generally transverse to an axis of elongation of said tubular rod; wherein said lock screw is rotatable within said aperture to move a shank of said lock screw through a wall defining said collar and into engagement with said shaft.

4. Apparatus in accordance with claim 1 wherein a recess is provided in said tubular rod immediately proximate an inner end of said simulator to accommodate one arm of a caliper.

5. Apparatus in accordance with claim 1 wherein said simulator is detachably mounted to said distal end of said tubular rod, wherein alternative simulators can be mounted to said tubular rod.

6. Apparatus in accordance with claim 1 wherein said tubular rod and said cartridge case simulator define a protective wall which insulates the receiver and chamber of the firearm from deleterious effects of solvents used in cleaning the bore of the weapon, and from abrasive action which results from a cleaning implement, when the bullet is removed and said cleaning implement is attached to said gauge means.

7. A multi-purpose firearm tool for use in loading a bullet in a corresponding cartridge case, having a forward mouth in which the bullet is to be tightly fitted, for use in a specific firearm with which the cartridge is compatible, wherein the firearm includes a barrel having defined therein, from a distal end thereof, a bore, a widened throat, adjacent the bore and generally coaxial therewith, and a greater widened chamber, adjacent the throat and generally coaxial therewith, the chamber configured to seat therein, for firing, a cartridge case to which a bullet has been loaded, comprising:

(a) a cartridge case simulator, said simulator having an open rear end and a narrowed mouth portion at a forward end, said simulator defining an axial passage therethrough;

(b) a tubular rod having means for fixedly mounting said simulator at a distal end of said tubular rod, wherein the tubular rod is adapted to feed said simulator through a receiver of the firearm to seat said simulator within the chamber, said tubular rod having an axial duct aligned, when said simulator is mounted at said distal end of said tubular rod, with said axial passage through said simulator;

(c) a gauge shaft slidably mounted for movement through said axial duct of said tubular rod and said axial passage of said simulator for urging a bullet, when said simulator is seated within the chamber, along said aligned axial duct and said axial passage by pushing said gauge shaft through said aligned duct and passage while a distal end of said shaft engages a base of the bullet; and (d) means for maintaining said gauge shaft in a defined axial position relative to said tubular rod, when said distal end of said gauge shaft is in engagement with the base of the bullet, the bullet protrudes through the mouth of said cartridge case simulator, and the bullet provides zero clearance to the entrance to the bore of the firearm.

8. A multi-purpose firearm tool in accordance with claim 7 wherein said tubular rod is provided with a recess immediately proximate an inner end of said simulator in order to accommodate one arm of a caliper.

* * * * *